US010100825B2

(12) United States Patent
Xiao et al.

(10) Patent No.: US 10,100,825 B2
(45) Date of Patent: Oct. 16, 2018

(54) DOWNHOLE CHEMICAL INJECTION METHOD AND SYSTEM FOR USE IN ESP APPLICATIONS

(71) Applicant: Saudi Arabian Oil Company, Dhahran (SA)

(72) Inventors: Jinjiang Xiao, Dhahran (SA); Hattan Banjar, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 354 days.

(21) Appl. No.: 14/736,656

(22) Filed: Jun. 11, 2015

(65) Prior Publication Data

US 2015/0369229 A1 Dec. 24, 2015

Related U.S. Application Data

(60) Provisional application No. 62/014,214, filed on Jun. 19, 2014.

(51) Int. Cl.

| | |
|---|---|
| ***F04B 23/04*** | (2006.01) |
| ***F04B 47/06*** | (2006.01) |
| ***F04D 1/04*** | (2006.01) |
| ***F04F 5/10*** | (2006.01) |
| ***F04D 13/08*** | (2006.01) |
| ***F04C 13/00*** | (2006.01) |
| ***E21B 37/06*** | (2006.01) |
| ***E21B 43/12*** | (2006.01) |
| *F04B 17/03* | (2006.01) |

(52) U.S. Cl.

CPC ..... *F04B 47/06* (2013.01); *E21B 37/06* (2013.01); *E21B 43/128* (2013.01); *F04C 13/008* (2013.01); *F04D 1/04* (2013.01); *F04D 13/08* (2013.01); *F04F 5/10* (2013.01); *F04B 17/03* (2013.01)

(58) Field of Classification Search

CPC ..... F04B 47/06; F04B 17/03; F04C 13/008; E21B 37/06; E21B 43/128; F04D 13/08

See application file for complete search history.

(56) References Cited

U.S. PATENT DOCUMENTS 4,266,607 A * 5/1981 Halstead ..... E21B 41/02 166/310
4,580,634 A * 4/1986 Cruise ..... E21B 37/06 166/105

(Continued)

OTHER PUBLICATIONS

PCT Partial International Search Report of the International Searching Authority dated Nov. 9, 2015; International Application No. PCT/US2015/036672; International Filing Date: Jun. 19, 2015.

(Continued)

*Primary Examiner* — Charles Freay
(74) *Attorney, Agent, or Firm* — Fish & Richardson P.C.

(57) ABSTRACT

Provided is a chemical injection pump that is installed below an electric submersible pump. In general, the chemical injection pump is either driven by an electric motor that draws power from the electric submersible pump motor or from energized fluid leaving the electric submersible pump output port. The electric submersible pump provides electric or hydraulic power to run the chemical injection pump. Therefore, no surface chemical injection pump is required and hence less space is needed.

1 Claim, 2 Drawing Sheets

(56) References Cited

U.S. PATENT DOCUMENTS

| | | | | |
|---|---|---|---|---|
| 4,582,131 | A * | 4/1986 | Plummer | E21B 37/06 166/310 |
| RE32,866 | E | 2/1989 | Cruise | |
| 5,845,709 | A | 12/1998 | Mack et al. | |
| 6,167,965 | B1 | 1/2001 | Bearden et al. | |
| 6,325,143 | B1 * | 12/2001 | Scarsdale | E21B 43/128 166/106 |
| 7,032,662 | B2 | 4/2006 | Malone et al. | |
| 7,259,688 | B2 | 8/2007 | Hirsch et al. | |
| 7,841,395 | B2 | 11/2010 | Gay et al. | |
| 9,932,806 | B2 * | 4/2018 | Stewart | E21B 47/0007 |
| 2002/0109080 | A1 * | 8/2002 | Tubel | E21B 23/03 250/227.14 |
| 2004/0060705 | A1 | 4/2004 | Kelley | |
| 2005/0166961 | A1 * | 8/2005 | Means | E21B 37/06 137/13 |
| 2006/0096760 | A1 * | 5/2006 | Ohmer | E21B 43/01 166/304 |
| 2008/0262737 | A1 | 10/2008 | Thigpen et al. | |
| 2009/0151953 | A1 * | 6/2009 | Brown | E21B 43/122 166/335 |
| 2011/0017459 | A1 | 1/2011 | Dinkins | |
| 2011/0024107 | A1 | 2/2011 | Sunyovszky et al. | |
| 2011/0155390 | A1 * | 6/2011 | Lannom | E21B 27/02 166/369 |
| 2015/0308245 | A1 * | 10/2015 | Stewart | E21B 43/128 166/250.01 |

OTHER PUBLICATIONS

J.J. Wylde et al., "Deep Downhole Chemical Injection on BP-Operated Miller: Experience and Learning", Society of Petroleum Engineers, SPE92832, May 11-12, 2005, Aberdeen, May 2006 SPE Production & Operations.

R.W. Cramer et al., "Development and Application of a Downhole Chemical Injection Pump for Use in ESP Applications", Society of Petroleum Engineers, SPE14403, Sep. 22-25, 1985, Las Vegas, NV.

PCT Partial International Search Report of the International Searching Authority dated Jan. 26, 2016; International Application No. PCT/US2015/036672; International Filing Date: Jun. 19, 2015.

International Preiiminary Report on Patentability issued in International Application No. PCT/US2015/036672 dated Dec. 29, 2016.

Office Action issued in GC Application No. 2015-29570 dated Apr. 17, 2018, 5 pages.

* cited by examiner

DOWNHOLE CHEMICAL INJECTION METHOD AND SYSTEM FOR USE IN ESP APPLICATIONS

CROSS REFERENCE TO RELATED APPLICATIONS

This application claims priority to and the benefit of co-pending U.S. Provisional Application No. 62/014,214, titled "Downhole Chemical Injection Method and System for Use in ESP Applications," filed Jun. 19, 2014, the full disclosure of which is hereby incorporated by reference herein in its entirety.

FIELD OF THE DISCLOSURE

This disclosure relates to production from wells and livening dead wells. More specifically, this disclosure relates to the use of electric submersible pumps ("ESP") and pressurized chemical injection for improving production rates from wells and livening dead wells.

BACKGROUND OF THE DISCLOSURE

ESPs are widely used in wells. ESPs are often used to increase the production rate of a well or to revive dead wells. Historically, harsh downhole environments which include scale production and corrosion products are not suitable for use with ESPs. Such environments can cause a decline in the ESP efficiency, as well as failures of the ESP in a short time period.

While an ESP is in use, a capillary tube is typically run from an injection pump at the surface through a tubing casing annulus ("TCA") to an injection port below the ESP motor in the well. Chemicals, such as scale inhibitor or corrosion inhibitor, are injected from a tank at the surface by a surface injection pump. The surface injection pumps require space at the surface.

SUMMARY

This disclosure relates to production from wells and livening dead wells. More specifically, this disclosure relates to the use of ESP and pressurized chemical injection for improving production rates from wells and livening dead wells. A need exists to reduce, or to eliminate completely, the space required for the injection pump at the surface.

In one embodiment, a damage resistant apparatus for enhancing production from a well is disclosed. The apparatus includes an electric submersible pump component having a first pump driver assembly and a chemical injection pump component operable to be disposed in the well. The chemical injection pump component has a second pump driver assembly operable independently from the first pump driver assembly, a top chemical pump portion, and an intake port adapted to be connected to a capillary tube operable to receive an inhibitor from a tank at a surface. The electric submersible pump component has a bottom portion adapted to be connected to top chemical pump portion.

In another embodiment, an apparatus for enhancing production from a well is disclosed. The apparatus includes an electric submersible pump component having an electric pump with a top electric pump portion and a bottom electric pump portion, a seal with a top seal portion and bottom seal portion, an electric submersible pump motor with a top electric submersible pump motor portion and a bottom electric submersible pump motor portion, and a monitoring tool with a top monitoring tool portion and a bottom monitoring tool portion. The electric pump has an electric pump intake that is operable to receive production fluids. The top seal portion is adapted to be connected to the bottom pump portion and the bottom seal portion is adapted to be connected to the top electric submersible pump motor portion. The bottom electric submersible pump motor portion is adapted to be connected to the top monitoring tool portion. Additionally, the bottom monitoring tool portion is adapted to be connected to a chemical injection pump component. The chemical injection pump component includes a chemical injection pump motor with a top chemical injection pump motor portion and a bottom chemical injection pump motor portion. The chemical pump has a top chemical pump portion and a bottom chemical pump portion. The chemical injection pump has an intake port adapted to be connected to a capillary tube operable to receive an inhibitor. The bottom chemical injection pump motor portion is adapted to be connected to the top chemical pump portion, and the top chemical injection pump motor portion is adapted to be connected to the bottom monitoring tool portion such that inhibitor is pumped in suitable amounts so as to protect the electric submersible pump component from downhole conditions In another aspect, an apparatus for enhancing production from a well is disclosed. The apparatus includes an electric submersible pump component that has an electric pump with a top electric pump portion and a bottom electric pump portion, a seal with a top seal portion and a bottom seal portion, an electric submersible pump motor with a top electric submersible pump motor portion and a bottom electric submersible pump motor portion, and a monitoring tool with a top monitoring tool portion and a bottom monitoring tool portion. The electric pump has an electric pump intake that is operable to receive production fluids. The top seal portion is adapted to be connected to the bottom pump portion and the bottom seal portion is adapted to be connected to the top electric submersible pump motor portion. The bottom electric submersible pump motor portion is adapted to be connected to the top monitoring tool portion. The bottom monitoring tool portion is adapted to be connected to a chemical injection pump component that has a chemical injection pump motor. The chemical injection pump has an intake port that is adapted to be connected to a capillary tube operable to receive an inhibitor in an amount operable to reduce damage to the electric submersible pump component. The electric pump portion further includes an electric pump discharge that is operable to discharge production fluids. The electric pump discharge has an output port that is adapted to be connected to a pressurized fluid passage. The pressurized fluid passage is operable to deliver fluids from the electric pump discharge to the chemical injection pump.

In other aspects, methods of using the apparatuses disclosed herein are provided. In some aspects, the method includes placing the apparatus in a casing in a well having a surface and downhole portion and then providing the inhibitor through the capillary tube to the intake port of the chemical injection pump and pumping the inhibitor into reservoir fluids in the well using the chemical injection pump.

In further embodiments, a damage resistant apparatus for enhancing production from a well is disclosed. The apparatus includes an electric submersible pump component having a first pump driver assembly, and a chemical injection pump component. The chemical injection pump component is operable to be disposed in the well and has a second pump driver assembly operable independently from the first pump driver assembly. The chemical injection pump component further has an intake port adapted to be connected to a capillary tube operable to receive an inhibitor from a tank at a surface. The electric submersible pump component is adapted to be connected to the chemical injection pump component.

DETAILED DESCRIPTION OF THE DISCLOSURE

Figure 1:
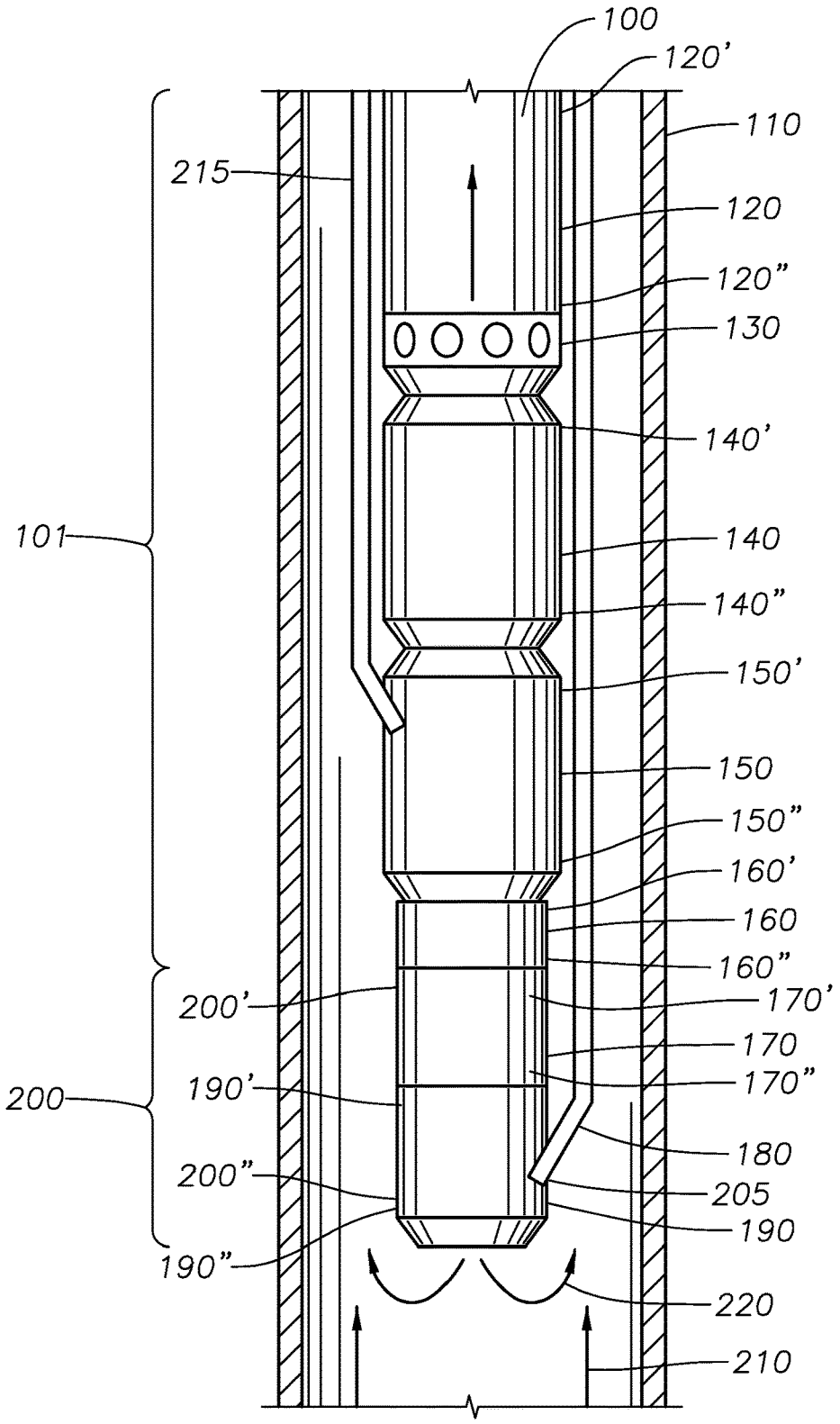
FIG. 1 shows an apparatus according to an embodiment of the present disclosure.

Although the following detailed description contains many specific details for purposes of illustration, it is understood that one of ordinary skill in the art will appreciate that many examples, variations and alterations to the following details are within the scope and spirit of the disclosure. Accordingly, the exemplary embodiments described herein and provided in the appended figures are set forth without any loss of generality, and without imposing limitations, on the claimed embodiments.

A damage resistant apparatus for enhancing production from a well is disclosed. The apparatus includes an electric submersible pump component 101 having a bottom portion and a chemical injection pump component 200, 300 operable to be disposed in the well. The chemical injection pump component 200, 300 has a top chemical pump portion 200', 300', and an intake port 205 adapted to be connected to a capillary tube 180 operable to receive an inhibitor 220 from a tank at a surface (not shown). The electric submersible pump component 101 has a bottom portion adapted to be connected to top chemical pump portion 200', 300'.

Figure 2:
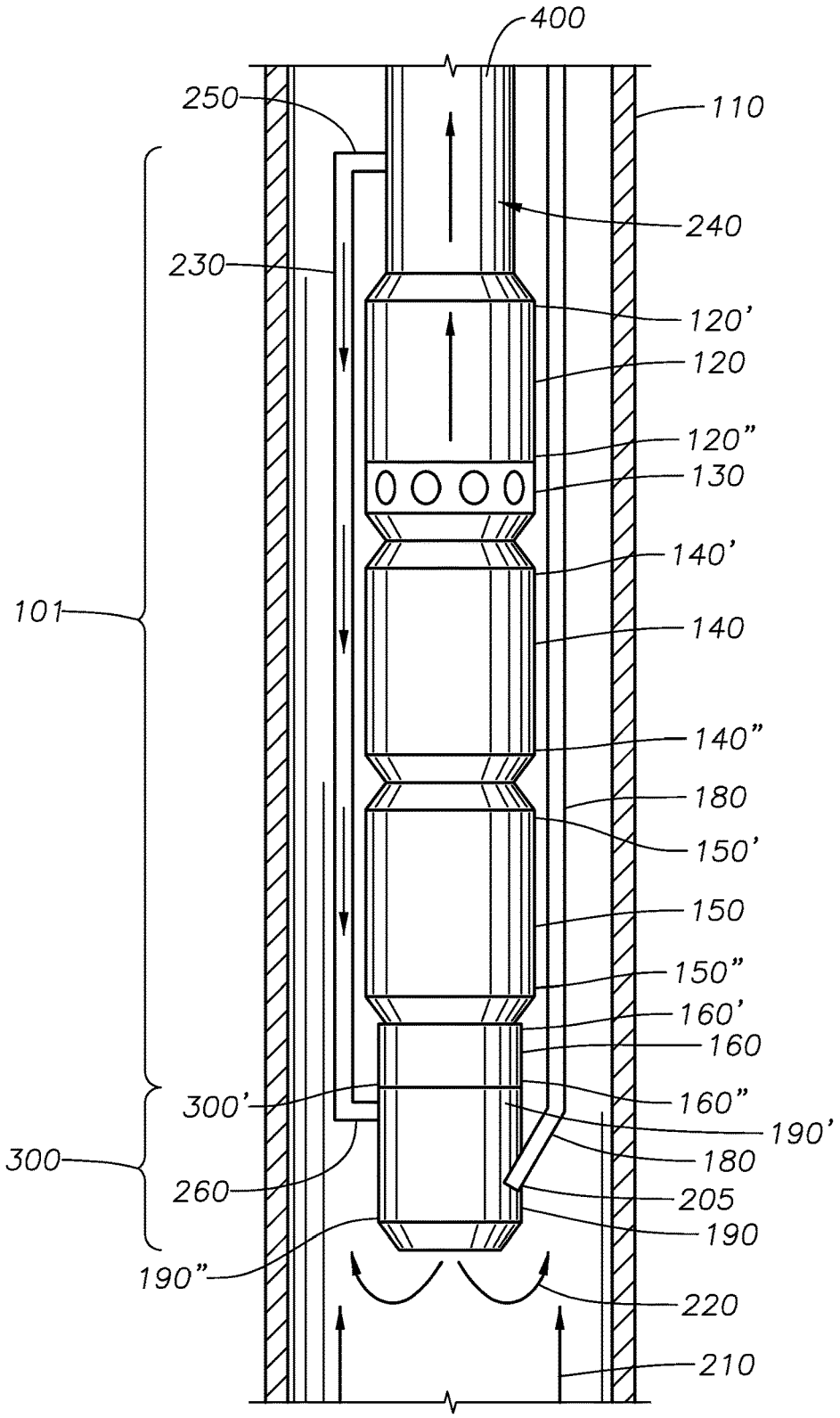
FIG. 2 shows an apparatus according to an embodiment of the present disclosure.

As shown in FIGS. 1 and 2, in embodiments of the present disclosure, a chemical injection pump component 200, 300 is installed below an electric submersible pump component 101. A first pump driver assembly can drive the electric submersible pump component 101 and a second pump driver assembly can drive the chemical injection pump component 200. The second pump driver assembly can operate independently from the first pump driver assembly so that the operating parameters of the chemical injection pump component 200, 300 can be controlled separately from the operating parameters of the electric submersible pump component 101. In some embodiments, such as the embodiment shown in FIG. 1, the chemical injection pump component 200 can be electrically driven by a power supply that is an electric motor that draws power from the electric submersible pump motor 150. In such embodiments where the electric motor draws power from the electric submersible pump motor 150, the pump can be any type of known pump, such as a positive displacement pump, or a centrifugal pump, or other known pumps. In some embodiments, the chemical injection pump component 200 is electrically driven with power supplied by the electric submersible pump motor 150 via electric cables 215 connecting externally or internally (not shown).

In embodiments, such as the shown in FIG. 2, the second pump driver assembly can have alternate embodiments. As an example, chemical injection pump component 300 can be driven by a portion of the energized fluid leaving the electric submersible pump output port 250, the pump is a jet pump, or any other type operationally connected to a turbine driven the energized fluid. Alternately, the chemical injection pump component 300 can be hydraulically driven by a portion of the pressurized fluid exiting the electric submersible pump discharge 240. In other embodiments, the chemical injection pump component 300 can be a jet pump, or any other type of pumps operably connected to a turbine which is driven by the hydraulic power of the pressurized fluids.

In some embodiments, such as that shown in FIG. 1, an apparatus 100 for enhancing production from a well is disclosed. The apparatus 100 includes an electric submersible pump component 101 having an electric pump 120 with a top electric pump portion 120' and a bottom electric pump portion 120", a seal 140 with a top seal portion 140' and bottom seal portion 140". Electric submersible pump component 101 further includes a first pump driver assembly for driving electric pump 120. The first pump driver assembly can include an electric submersible pump motor 150 with a top electric submersible pump motor portion 150' and a bottom electric submersible pump motor portion 150". Electric submersible pump component 101 can also have a monitoring tool 160 with a top monitoring tool portion 160' and a bottom monitoring tool portion 160". The electric pump has an electric pump intake 130 that is operable to receive production fluids 210. The top seal portion 140' is adapted to be connected to the bottom electric pump portion 120" and the bottom seal portion 140" is adapted to be connected to the top electric submersible pump motor portion 150'. The bottom electric submersible pump motor portion 150" is adapted to be connected to the top monitoring tool portion 160'. Additionally, the bottom monitoring tool portion 160" is adapted to be connected to a chemical injection pump component 200. The chemical injection pump component 200 includes a second pump driver assembly for providing the power to drive the chemical pump 190 of chemical injection pump component 200. In an example embodiment, the second pump driver assembly is a chemical injection pump motor 170 that is a different motor than electric submersible pump motor 150. Chemical injection pump motor 170 has a top chemical injection pump motor portion 170' and a bottom chemical injection pump motor portion 170". The chemical injection pump component 200 has a top chemical injection pump component 200' and a bottom chemical injection pump component 200". The chemical pump 190 has a top chemical pump portion 190' and a bottom chemical pump portion 190". The chemical injection pump component 200 has an intake port 205 adapted to be connected to a capillary tube 180 operable to receive an inhibitor 220. The bottom chemical injection pump motor portion 170" is adapted to be connected to the top chemical pump portion 190', and the top chemical injection pump motor portion 170' is adapted to be connected to the bottom monitoring tool portion 160".

In another embodiment, such as the one shown in FIG. 2, an apparatus 400 for enhancing production from a well is disclosed. The apparatus 400 includes an electric submersible pump component 101 that has an electric pump 120 with a top electric pump portion 120' and a bottom electric pump portion 120", a seal 140 with a top seal portion 140' and a bottom seal portion 140", an electric submersible pump motor 150 with a top electric submersible pump motor portion 150' and a bottom electric submersible pump motor portion 150", and a monitoring tool 160 with a top monitoring tool portion 160' and a bottom monitoring tool portion 160". The electric pump 120 has an electric pump intake 130 that is operable to receive production fluids. The top seal portion 140' is adapted to be connected to the bottom pump portion and the bottom seal portion 140" is adapted to be connected to the top electric submersible pump motor portion 150'. The bottom electric submersible pump motor portion 150" is adapted to be connected to the top monitoring tool portion 160'. The bottom monitoring tool portion 160" is adapted to be connected to a chemical injection pump component 300. The chemical injection pump component 300 has an intake port 205 that is adapted to be connected to a capillary tube 180 operable to receive an inhibitor 220. The electric pump portion further includes the electric submersible pump discharge 240 that is operable to discharge production fluids. The electric submersible pump discharge 240 has an output port 250 that is adapted to be connected to a pressurized fluid passage 230. The pressurized fluid passage 230 is operable to deliver fluids from the electric pump 120 discharge to the chemical injection pump component 200 via inport port 260.

In other embodiments, methods of using the apparatuses disclosed herein are provided. In some aspects, the method includes placing the apparatus in a casing 110 in a well having a surface and downhole portion and then providing the inhibitor 220 through the capillary tube 180 to the intake port 205 of the chemical injection pump component 200 and pumping the inhibitor 220 into reservoir fluids 210 in the well using the chemical injection pump component 200.

The electric submersible pump component 101 includes an electric pump 120, a seal 140, an electric submersible pump motor 150, and a monitoring tool 160. The electric submersible pump component 101 can be any known electric submersible pump. In general the electric submersible pump component 101 is made of materials that allow it to handle harsh conditions encountered downhole, including exposure to temperatures and pressures, abrasive materials, and salt containing fluids that form deposits of scale, and paraffin or asphaltenes, and so forth.

In some embodiments, the seal 140 is located between the electric submersible pump motor 150 and the pump intake 130. The seal 140 generally functions to contain the thrust bearing that carries the axial thrust developed by the electric submersible pump component 101, protects the motor from fluids, equalizes the pressure in the wellbore with the pressure inside the motor and compensates for the expansion and contraction of motor oil due to internal temperature changes.

In some embodiments, the electric submersible pump motor 150 energy comes from an alternating current source that operates at high temperatures and pressures encountered downhole. The electric submersible pump motor 150 is designed such that it is operable to lift the estimated volume of production in a given region. In some embodiments, the electric submersible pump motor 150 is powered from the surface via a submersible electric cable 215.

In some embodiments, the monitoring tool 160 interfaces with a surface interface unit (now shown). In some embodiments, the monitoring tool 160 measures intake pressures, wellbore and motor oil or winding temperature, pump discharge pressure, vibration, current leakage, and flow rate. In further embodiments, the monitoring tool 160 functions in real-time. In some embodiments, the interfacing with the surface interface is accomplished using a permanent digital readout, handheld data logger, or laptop computer. In some embodiments, data provided from the monitoring tool 160 to the surface interface unit is monitored from a remote location. A person of skill in the art will understand how to select an appropriate monitoring tool. Monitoring tools according to some embodiments of the present disclosure include monitoring tools available from Sercel-GRC Corp. of Tulsa, Okla., USA.

Various chemicals are injected downhole using embodiments of the present disclosure, including chemicals for prevention of corrosion, as well as for prevention of precipitation and deposition of solids such as scale, wax, and asphaltene. In some embodiments, the chemicals are inhibitors. Inhibitors inhibit the precipitation and deposition of solids. In some embodiments, the injection rate is a predetermined liters per day such that the chemical mixes with production fluids such that in the water phase the chemical concentration reaches a desired ppm level. When used in this disclosure, the term "ppm" is defined as parts per million by volume. In the interest of clarity, as an example, if the concentration of applicable substance is 20 ppm and the well produces 2000 bbls of water per day, the injection rate of the applicable substance will be 20/1,000,000*2000=0.04 bbls per day or 1.68 gallons per day. In some embodiments, the injection rate is such that the chemical reaches a concentration in the range of about 5 to 20 ppm of the water phase of the production fluids, measured from a sample that is downhole but close to the surface. In further embodiments, the chemical reaches a concentration in the range of about 3 to 50 ppm. In further embodiments, the chemical reaches a concentration in the range of about 3 ppm to 5 ppm. In further embodiments, the chemical reaches a concentration in the range of about 5 ppm to 10 ppm. In further embodiments, the chemical reaches a concentration in the range of about 10 ppm to 15 ppm. In further embodiments, the chemical reaches a concentration in the range of about 15 ppm to 20 ppm. In further embodiments, the chemical reaches a concentration in the range of about 20 ppm to 25 ppm. In further embodiments, the chemical reaches a concentration in the range of about 25 ppm to 30 ppm. In further embodiments, the chemical reaches a concentration in the range of about 30 ppm to 35 ppm. In further embodiments, the chemical reaches a concentration in the range of about 35 ppm to 40 ppm. In further embodiments, the chemical reaches a concentration in the range of about 40 ppm to 45 ppm. In further embodiments, the chemical reaches a concentration in the range of about 45 ppm to 50 ppm. In further embodiments, the chemical reaches a concentration of about 50 ppm. The desired concentration depends on several factors, such as the type of chemical, the severity of the scaling and corrosion issue, and pressure and temperature parameters. A range of chemical injection dosages are used for scale or corrosion treatment. A person of skill in the art will understand how to determine appropriate chemical injection dosages for a given well based on known parameters of a given well.

In some embodiments, the capillary tube 180 runs through the electric submersible pump component 101 and transports chemicals to the intake 205 of the chemical injection pump component 200, 300. Chemicals discharged from the chemical injection pump component 200, 300 mix with the production fluids 210 for treatment. In some embodiments, the capillary tube 180 is ¼ inch in diameter and it is run from the surface chemical tank in the TCA. In further embodiments, the capillary tube 180 can be about ⅜ inch in diameter. A person of skill in the art will understand that the capillary tube 180 can be selected based on the injection rate required. In some embodiments, the capillary tube 180 is attached to the production tubing in the TCA to prevent damaging the capillary tube 180. In some embodiments, a check valve is installed along the capillary tube 180 to prevent reservoir fluids 210 from coming to the surface.

In some embodiments, the chemical injection pump component 200, 300 operates independent of the operation parameters of the electric submersible pump component 101, such as its rotational speed. In such embodiments, the chemical injection pump component 200, 300 can be driven, and controlled separately from the operation of the electric submersible pump component 101 so that rate at which inhibitor 220 is pumped into reservoir fluids 210 in the well can be varied over time. As an example, the rotational speed of the chemical injection pump component 200, 300 may have to be, and can be, different than the rotational speed of the electric submersible pump component 101 in order to achieve a desired dosage of inhibitor 220 within reservoir fluids 210 in the well. The separate means for driving chemical injection pump component 200, 300, can be, for example, the chemical injection pump motor 170, the portion of the energized fluid leaving the electric submersible pump output port 250, or the portion of the pressurized fluid exiting the electric submersible pump discharge 240. Each such means for driving chemical injection pump component 200, 300 can cause the chemical injection pump component 200, 300 to rotate at a different rate of speed than the electric submersible pump component 101.

In further embodiments, the chemical injection pump component 200, 300 is controlled from surface via the electric cable 215. In some embodiments, such as embodiments having a hydraulically powered chemical injection pump component 200, 300, the check valve is controlled to set the injection rate at the desired speed. In some embodiments, the use of a chemical injection pump component 200, 300 does not affect the electric submersible pump component 101 performance.

One of skill in the art will understand that the electric submersible pumps that are operable in the present disclosure can include so called inverted electric submersible pumps. In inverted electric submersible pumps, the electric submersible pump motor is on top, the electric pump is on the bottom, and the seal is in between (not shown). In such an embodiment, the electric submersible pump component (the equivalent of component 101) has an electric pump with a top electric pump portion and a bottom electric pump portion, a seal with a top seal portion and bottom seal portion, an electric submersible pump motor with a top electric submersible pump motor portion and a bottom electric submersible pump motor portion, and a monitoring tool portion having a top monitoring tool portion and a bottom monitoring tool portion. The electric pump has an electric pump intake that is operable to receive production fluids. The top seal portion is adapted to be connected to the bottom electric submersible pump motor portion and the bottom seal portion is adapted to be connected to the top electric pump portion. The bottom electric pump portion is adapted to be connected to the top monitoring tool portion. Additionally, the bottom monitoring tool portion is adapted to be connected to a chemical injection pump component. The chemical injection pump component includes any of the chemical injection pump component known in the art, including the chemical injection pump components described herein.

Embodiments of the present disclosure are effective as they utilize the existing ESP electric or hydraulic power to run a chemical injection pump for the sake of chemical treatment. No surface injection pump is required and hence less space is needed.

Although the present embodiments have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the disclosure pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

That which is claimed is:

1. A damage resistant apparatus for enhancing production from a well, the apparatus comprising:

an electric submersible pump component having a first pump driver assembly;

a chemical injection pump component operable to be disposed in the well, the chemical injection pump component having a second pump driver assembly operable independently from the first pump driver assembly and a top chemical pump portion, further having an intake port; and a capillary tube fluidically connected to the intake port, the capillary tube extending from the intake port to a surface of the well, the capillary tube configured to receive an inhibitor from a tank at the surface, wherein the electric submersible pump component has a bottom portion adapted to be connected to the top chemical pump portion.

* * * * *